United States Patent [19]

Horning

[11] 3,949,940

[45] Apr. 13, 1976

[54] TUBE MILL

[75] Inventor: Bent Horning, Copenhagen Valby, Denmark

[73] Assignee: F. L. Smidth & Co., Cresskill, N.J.

[22] Filed: Mar. 19, 1974

[21] Appl. No.: 452,504

[30] Foreign Application Priority Data

Mar. 23, 1973 United Kingdom ..... 14214/73

[52] U.S. Cl. ..... 241/30; 241/52; 241/54; 241/70; 241/80; 241/176

[51] Int. Cl.[2] ..... B02C 17/06

[58] Field of Search ..... 241/24, 29, 30, 49, 52, 241/54, 70, 71, 72, 76, 78, 79, 79.2, 80, 171, 176

[56] References Cited

UNITED STATES PATENTS

| | | | |
|---|---|---|---|
| 1,427,234 | 8/1922 | Sherban | 241/70 X |
| 2,185,960 | 1/1940 | Vogel-Jorgensen | 241/54 X |
| 2,399,051 | 4/1946 | Maxson et al. | 241/52 |
| 3,712,549 | 1/1973 | Cleemann | 241/24 X |

*Primary Examiner*—Granville Y. Custer, Jr.
*Attorney, Agent, or Firm*—Pennie & Edmonds

[57] ABSTRACT

An air-swept tube mill having at least two grinding chambers and a discharge chamber, an internal by-pass means in the last grinding chamber in communication at one end with the grinding chamber immediately preceding the last grinding chamber and at the other end, with the discharge chamber, whereby material ground in the first chamber is transferred through the by-pass directly to the discharge chamber and oversize material is transferred from the discharge chamber to the last grinding chamber for further grinding. A unique method is disclosed in which grinding of material takes place in a first grinding chamber of a tube mill and by-passed into a discharge chamber. The method further comprises feeding oversize materials from the discharge chamber into a last grinding chamber for additional grinding thereof.

20 Claims, 5 Drawing Figures

TUBE MILL

BACKGROUND OF THE INVENTION

1. Field of the Invention

The present invention is concerned with improvements in air-swept tube mills of the kind having at least two grinding chambers, a discharge chamber and an outlet which is preferably central, for instance through a hollow trunnion.

2. Descriptions of the Prior Art

In tube mills of the type contemplated, material is generally conveyed through the mill and out of the mill suspended more or less in an air current drawn or forced through the mill. The air current may be a cold or hot gas stream and may also serve the purpose of drying the material ground in the mill. Generally the finely ground material carried out of the mill suspended in the air current also comprises some coarse particles. In most instances it is necessary to separate off such coarse particles and return them to the mill for further grinding.

In a conventional grinding installation the grinding mill and the separator are generally individual units provided with tubes leading the airborne material from the mill to the separator from which the oversize material is usually returned to the mill inlet. However a manufacturing process according to this procedure is not always suitable for grinding mineral materials in raw materials for the manufacture of cement. In particular, when the raw material is moist and has to be dried in a drying chamber associated with the mill as a first treatment chamber succeeded by grinding chambers, it is difficult and uneconomical to mix the oversize material with the fresh material.

To solve this problem it has previously been suggested to divide the grinding process into two steps by utilizing mills having peripheral outlets through which the dried and preferably initially ground product is discharged from a first part of the mill and conveyed to a separator, whereupon the oversize material is returned to the second part of the mill in which the fine grinding takes place.

Further, it has been suggested to combine the grinding mill and the separator into one unit in which the mill is provided with screw conveyors or other means serving to return the oversize material to the first or second grinding chamber. However, the installation of returning means such as internal screw conveyors or the like involve a number of complications.

According to the invention in an air-swept tube mill having at least two grinding chambers and a discharge chamber, at least the second or last grinding chamber has an internal by-pass through which the first grinding chamber communicates with the discharge chamber, enabling ground material to by-pass the second or last grinding chamber. The second or last grinding chamber is arranged to receive material from the discharge chamber for grinding during passage of the material in a direction opposite that of the direction in which the material is conveyed through the preceding grinding chamber, the material being discharged into the air stream through the by-pass.

A feature of the present invention relates to the provision of a new mill design provided with means which makes it possible to circulate part of the material internally for a continued or renewed grinding to obtain the fineness of the product aimed at.

The invention also relates to a method of grinding material in an air-swept tube mill, wherein unground material and air are fed into one end of the mill and are passed through at least one grinding chamber from which the ground material, entrained in the air, is carried through an internal by-pass through a second or last grinding chamber into a discharge chamber at the other end of the mill, oversize material being caused to pass back from the discharge chamber through the second or last grinding chamber for further grinding and then being entrained by the air flowing into the by-pass again.

The material treated in a mill according to the invention may thus be circulated inside the mill without the use of complicated conveying installations. Thus, a separation of the material treated in the first part of the mill may, for instance, be performed in the discharge chamber, for example, by means of a deflector which deflects the air passing through the chamber so that the coarse particles are separated off in the discharge chamber and subsequently fed to and ground in the second or last grinding chamber.

Preferably, a central tube through the second or last grinding chamber constitutes the by-pass. The air or gas passing through the mill then passes centrally through the second or last grinding chamber without being deflected during this passage. The second or last grinding chamber is arranged concentric with the central tube so that its grinding performance, as regards peripheral speed in relation to the critical speed, is the same as for the other grinding chamber or chambers. Further, the feeding of this grinding chamber may be effected from the discharge compartment by means of conventional lifters and the discharge from the grinding chamber may also be effected by means of a conventional device of scoops which may lift and discharge the material into the air or gas current through the central tube.

The tube mill may include a drying compartment at the inlet end of the mill together with means for feeding hot gas through the mill. The air or gas utilized in the mill thereby serves the dual purpose of drying the material and conveying the ground or semi-ground material through the mill and out of it.

In one example, especially in the construction having a central tube, the tube mill includes an air separator unit mounted co-axially with the mill and arranged to treat the gas with entrained material passing through the by-pass and means for returning oversize material to the discharge chamber.

It has been known to combine a conventional tube mill with an air separator in this manner, but such installations have not been adopted to any appreciable extent because of the complications involved when returning the oversize material to a grinding stage for re-grinding whether this is done by means of external conveyors or internal conveyors, such as a screw conveyor or other equipment. In one design according to the invention the conveyance of the oversize particles does not cause any problems because the oversize material is returned from the discharge chamber directly to the second or last grinding chamber.

The applicability and the efficiency of a mill according to the invention is further improved if the air separator is built into and associated with the mill and has a separate driving mechanism outside the mill.

The air separator preferably forms part of the discharge chamber so that the walls of same constitute the housing for the air separator from which the over-size coarse material is led directly into the last or second grinding compartment by means of a conventional scoop device, whereas the air or gas conveys the final ground product which has passed through the air separator out of the installation. The final material may then be separated from the air or the gas, for example in a cyclone plant outside the mill.

When the gas fed to the mill for the carrying or drying is a gas from another manufacturing unit, such as waste gas from a rotary kiln plant, the amount of gas obtainable depends upon the production in the rotary kiln and is difficult to adapt straight away to the amount required for the grinding and drying because the amount is often too low. To make up for a deficit in this respect the mill may have one or more openings for the supply of additional air to the separator. The amount of air or gas for the drying and the conveyance of the material may be insufficient for the proper function of the air separator so that additional air may be supplied preferably to the discharge chamber and, in one construction, through a passage arranged in the driving shaft of the air separator.

The opening or openings for supplying "additional air" may be provided with means for controlling the amount of air passing therethrough. Air control of this kind may serve to ensure the supply of a correctly measured amount of air to the air separator and thereby obtain the best possible performance of the separator without influencing a drying process, if arranged in a drying compartment at the inlet end of the mill or without influencing the conveyance of the material through the grinding chambers.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
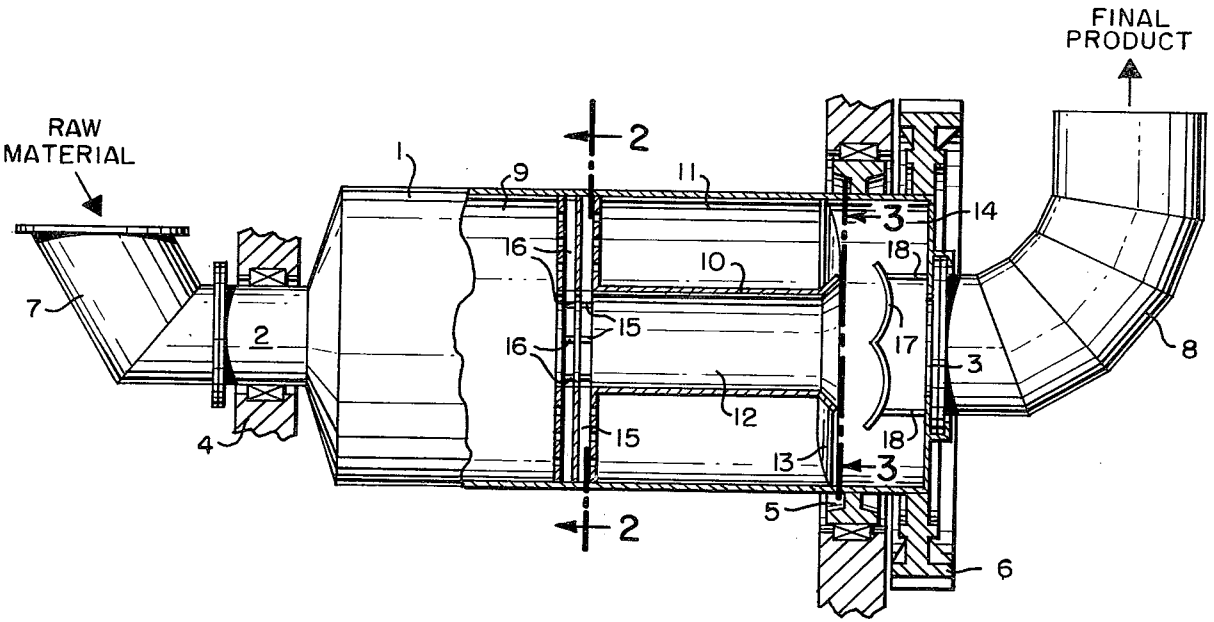
FIG. 1 is a longitudinal, partial cross-sectional view of a mill having two grinding compartments.
Figure 3:
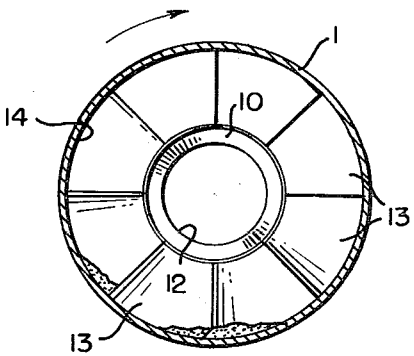
FIG. 3 is a cross-sectional view taken along line 3—3 of FIG. 1.
Figure 2:
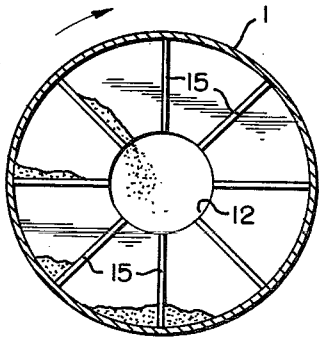
FIG. 2 is a cross-sectional view taken along line 2—2 of FIG. 1.

The mill shown in FIG. 1 comprises a mill shell 1 having an inlet 2 and an outlet 3. The mill is at the inlet end supported by a bearing 4 and at the outlet end by sliding bearing blocks via a live ring 5. The mill is driven by a driving mechanism (not shown), which engages a gear wheel 6 mounted on the mill.

The inlet end 2 of the mill is equipped with a stationary inlet chute 7 for the supply of raw material to the mill and for the admission of air or gas. The outlet end is likewise equipped with a stationary tube 8 through which the air and the ground material may leave the mill. Internally the mill has a first grinding chamber 9 and a central tube 10 dividing part of the mill into a second grinding chamber 11 and a by-pass 12 through the central tube 10. Further, the second grinding chamber 11 has a scoop device 13 for feeding material into the grinding chamber from a discharge chamber 14 and an outlet diaphragm with lifters 15 for lifting material to be discharged into the by-pass through the central tube 10. The first grinding chamber also has an outlet diaphragm with lifters 16. The discharge chamber 14 has an air deflector 17 supported by bars 18.

Figure 4:
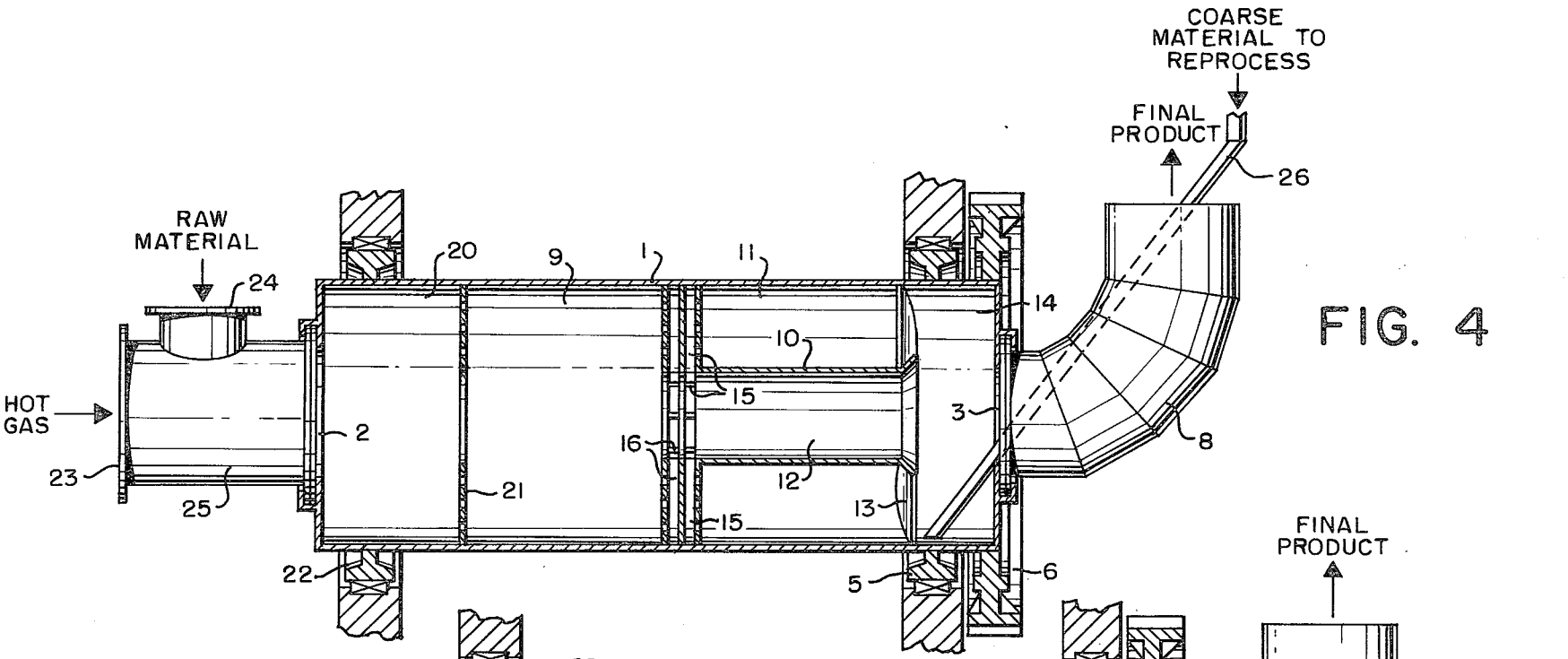
FIG. 4 is a longitudinal, partial cross-sectional view of a mill having two grinding compartments and a drying compartment.

The mill shown in FIG. 4 has the same components as the mill shown in FIG. 1, but in addition, includes a drying compartment 20, having a sieving diaphragm 21 serving as an entry to the first grinding compartment. Also, the inlet end of the mill in this example is supported by sliding bearing blocks via a second live ring 22 instead of being supported in a trunnion bearing in order to protect the bearing from being damaged by the hot gases necessary for the drying process which gas is fed to the mill through a separate inlet 23, the material being fed through an inlet opening 24 of a stationary inlet casing 25. A return pipe 26 may be provided at the outlet end for returning coarse material to the discharge chamber 14.

Figure 5:
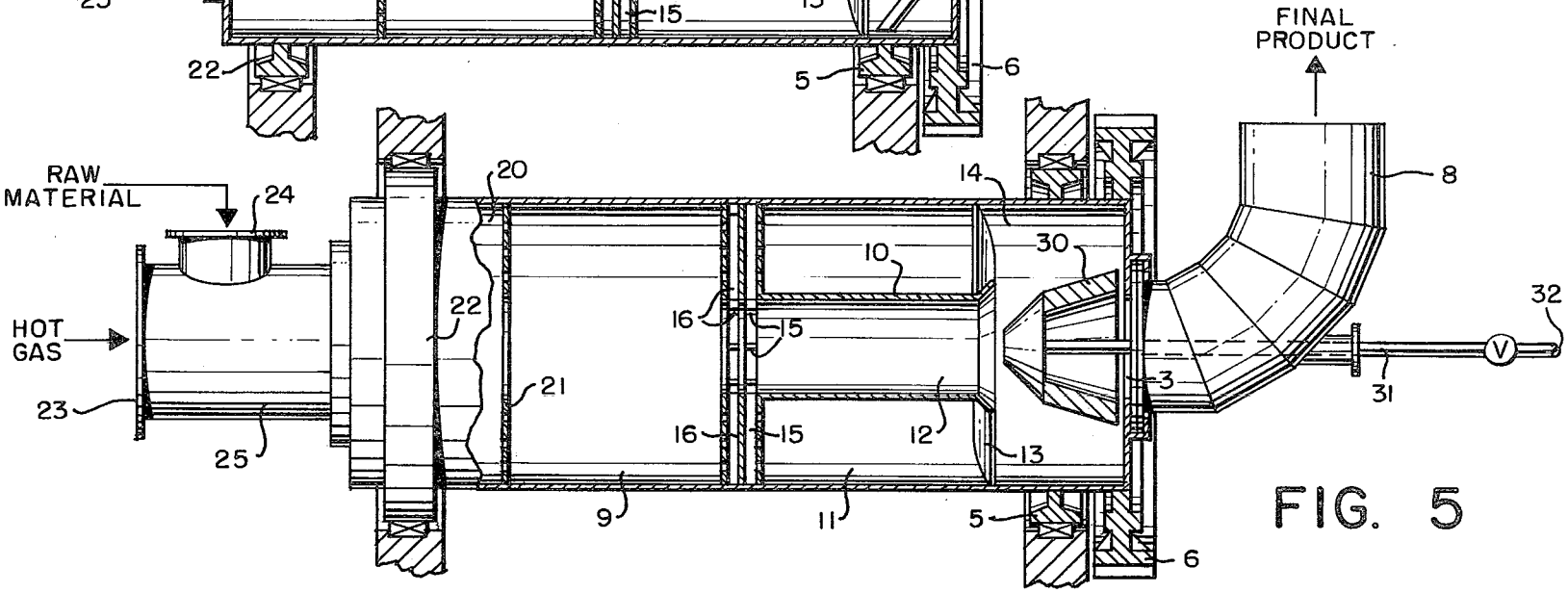
FIG. 5 is a longitudinal, partial cross-sectional view of a mill similar to the mill of FIG. 4, but having a built-in air separator.

The tube mill shown in FIG. 5 corresponds to that shown in FIG. 4 except that the return pipe 26 is omitted and an air separator wheel 30 is mounted in the discharge chamber. The air separator 30 has a shaft 31 extending out of the mill and connected to a driving mechanism not shown in the drawing. The shaft 31 is hollow so as to form a channel 32 for the supply of additional gas, air or other fluid medium.

The raw material to be ground in the mill is, for instance, supplied to the mill by means of a weigh feeder through the inlet chute 7 or opening 24 together with necessary amounts of air or gas to serve as carrier gas for the ground or semi-ground material. The raw material is pre-ground in the first chamber 9 and at the end of the chamber, screened through the diaphragm 16, which has lifters to lift the material which is sufficiently ground to be able to pass the diaphragm, into the air flowing through the first grinding chamber and subsequently through the by-pass 12 to the discharge chamber 14. In the discharge chamber the coarse particles may be separated from the air stream due to the drop in velocity, which separation may possibly be assisted by built-in deflectors of various known types. The coarse particles are by means of the scoop device 13 fed to the second grinding chamber 11 in which a fine grinding takes place. The product is screened through the diaphragm 15 having lifters which lift the material into the air stream passing through the by-pass to join the material discharged from the lifters 16. Thus there is no direct connection between the first grinding chamber 9 and the second grinding chamber 11, the only connection being through the by-pass 12, the discharge chamber 14 and the scoop device 13.

This construction therefore provides the possibility of introducing a separating process between two grinding steps and to provide a circulation of coarse material within the mill.

In the mill shown in FIG. 4 the material is dried in the drying chamber 20 before grinding takes place in the grinding chambers 9 and 11. The drying is carried through by means of hot gases introduced through the gas inlet opening 23, which gas is subsequently utilized as carrying gas through the mill.

The installation shown has a return pipe 26 through which coarse material may be returned to the discharge chamber 14 from an additional separation taking place outside the mill, for instance in a cyclone or an air separator.

Meanwhile, the circulation of the oversize material in the grinding process takes place in the same manner as described above. In the example shown in FIG. 5 a final separation of the product is performed in the discharge chamber 14 by means of the separator wheel 30 built into the discharge chamber. The final fine ground material is discharged through the tube 8 whereas the oversize particles drop from the separator in the discharge chamber to be collected in the lower part of the chamber from where they proceed into the second grinding chamber 11. Additional air to ensure a perfect performance of the separator is supplied through the channel 32 from the driving shaft of the separator by a controlling valve of a known type as shown schematically in FIG. 5.

I claim:

1. A method of grinding material in an air-swept tube mill comprising: feeding material and at least one of air and gas into one end of the mill; grinding said material in at least a first grinding chamber; entraining the ground material in said air or gas; carrying said entrained material through a material imperforate internal by-pass conduit through a last grinding chamber into a discharge chamber at the outlet end of the mill, said conduit communicating at one end with a grinding chamber immediately preceding the last grinding chamber and at the other end with the discharge chamber at the outlet end of the mill; feeding material greater than a predetermined size back from the discharge chamber through the last grinding chamber in a direction opposite to the direction in which it is conveyed through the preceding grinding chamber; further grinding the oversize material during passage of said material through said last grinding chamber in said opposite direction; conveying said additionally ground material from said last grinding chamber to said by-pass conduit; and entraining said finely ground material in said air or gas and discharging said entrained material through said by-pass conduit out of the mill.

2. A tube mill of the air-swept type comprising at least two grinding chambers and a discharge chamber, combined inlet means for supplying material to be ground and at least one of sweeping air and gas to a first of said at least two grinding chambers, an imperforate internal material by-pass conduit in the last grinding chamber, said by-pass conduit communicating at one end with the grinding chamber immediately preceding the last grinding chamber and at the other end with the discharge chamber, means for transferring ground material from said grinding chamber preceding the last grinding chamber into said by-pass conduit and swept by said air or gas through said by-pass conduit to the discharge chamber, means for transferring relatively coarse material requiring additional grinding from the discharge chamber to the last grinding chamber in a direction opposite to the direction in which it is conveyed through the preceding grinding chamber for further grinding during passage of said material through the last grinding chamber in said opposite direction, and means for transferring the finely ground material from the last grinding chamber to the inlet of said by-pass conduit so that the finely ground material is discharged through said by-pass conduit.

3. The air-swept tube mill according to claim 1 wherein said by-pass conduit comprises a substantially central tube through the last grinding chamber and extending from the grinding chamber immediately preceding the last grinding chamber to the discharge chamber and said means for transferring relatively coarse material to the last grinding chamber comprises a scoop device positioned adjacent the material outlet portion of said tube.

4. The air-swept tube mill according to claim 1 further comprising a drying chamber positioned at the inlet end of the mill in communicating relation with the first grinding chamber.

5. The air-swept tube mill according to claim 4 further comprising an air separator means mounted within said discharge chamber co-axially with the mill and arranged to be rotated at high speeds so as to separate relatively oversized material particles having at least a predetermined size from the gas or air passing through the by-pass conduit such that said oversized material may be returned to the last grinding chamber through which the by-pass conduit extends.

6. The air-swept tube mill accordng to claim 5 wherein the air separator means is supported within said discharge chamber with means for driving the separator positioned externally of the mill.

7. The air-swept tube mill according to claim 1 further comprising an air separator means mounted within said discharge chamber co-axially with the mill and arranged to be rotated at high speeds so as to separate relatively oversized material particles having at least a predetermined size from the gas or air passng through the by-pass conduit such that said oversized material may be returned to the last grinding chamber through which the by-pass conduit extends.

8. The air-swept tube mill according to claim 7 wherein the air separator means is supported within said discharge chamber with means for driving the separator positioned externally of the mill.

9. The air-swept tube mill according to claim 1 further comprising a drying chamber positioned at the inlet end of the mill in communicating relation with the first grinding chamber.

10. The air-swept tube mill according to claim 2 further comprising an air separator means mounted within said discharge chamber co-axially with the mill and arranged to be rotated at high speeds so as to separate relatively oversized material particles having at least a predetermined size from the gas or air passing through the by-pass conduit such that said oversized material may be returned to the last grinding chamber through which the by-pass conduit extends.

11. The air-swept tube mill according to claim 6 wherein the air separator means is supported within said discharge chamber with means for driving the separator positioned externally of the mill.

12. The air-swept tube mill according to claim 1 further comprising an air separator means mounted within said discharge chamber co-axially with the mill and arranged to be rotated at high speeds so as to separate relatively oversized material particles having at least a predetermined size from the gas of air passing through the by-pass conduit such that said oversized material may be returned to the last grinding chamber through which the by-pass conduit extends.

13. The air-swept tube mill according to claim 12 wherein the air separator means is supported within said discharge chamber with means for driving the separator positioned externally of the mill.

14. The air-swept tube mill according to claim 13 wherein the tube mill defines at least one additional opening which extends into the discharge chamber for directing a supply of additional air to the separator to ensure continuous performance of the separator.

15. The air-swept tube mill according to claim 14 wherein the separator is driven by a drive shaft from an external drive means through a portion of the mill and the additional opening through which additional air is provided for the separator comprises a passage extending through said shaft.

16. The air-swept tube mill according to claim 15 further comprising valve means in said passageway for controlling the additional air passing through said passageway in said shaft.

17. The air-swept tube mill according to claim 12 wherein the tube mill defines at least one additional opening which extends into the discharge chamber for directing a supply of additional air to the separator to ensure continuous performance of the separator.

18. The air-swept tube mill according to claim 17 wherein the separator is driven by a drive shaft from an external drive means through a portion of the mill and the additional opening through which additional air is provided for the separator comprises a passage extending through said shaft.

19. The air-swept tube mill according to claim 18 further comprising valve means in said passageway for controlling the additional air passing through said passageway in said shaft.

20. An air-swept tube mill having a combined inlet for air and material to be ground comprising:

a. a first drying chamber;

b. a first grinding chamber communicating with the drying chamber and adjacent thereto;

c. a second grinding chamber communicating with the first grinding chamber and adjacent thereto;

d. a discharge chamber communicating with the second grinding chamber and adjacent thereto;

e. a combined inlet for supplying material to be ground and at least one of sweeping air and gas to said chambers;

f. an imperforate internal material by-pass tube extending through the third grinding chamber communicating at the inlet end with the first grinding chamber and communicating at the outlet end with the discharge chamber;

g. means for transferring ground material from the first grinding chamber through the by-pass tube to the discharge chamber;

h. means for transferring relatively coarse material requiring additional grinding from the discharge chamber to the last grinding chamber in a direction opposite to the direction in which it is conveyed through the preceding grinding chamber for further grinding during passage of said material through the last grinding chamber in said opposite direction; and i. means for transferring the finally ground material from the last grinding chamber to the inlet of said by-pass tube so that the finely ground material is discharged through said by-pass tube into the stream of air or gas.

* * * * *

UNITED STATES PATENT AND TRADEMARK OFFICE

CERTIFICATE OF CORRECTION

PATENT NO. : 3,949,940

DATED : April 13, 1976

INVENTOR(S) : Bent Horning

It is certified that error appears in the above–identified patent and that said Letters Patent are hereby corrected as shown below:

At Col. 5, line 65, change the dependency of claim 3 from "1" to --2--.

At Col. 6, line 6, change the dependency of claim 4 from "1" to --3--.

At Col. 6, line 23, change the dependency of claim 7 from "1" to --3--.

At Col. 6, line 28, "passng" should read --passing--.

At Col. 6, line 36, change the dependency of claim 9 from "1" to --2--.

At Col. 6, line 40, change the dependency of claim 10 from "2" to --9--.

At Col. 6, line 49, change the dependency of claim 11 from "6" to --10--.

At Col. 6, line 53, change the dependency of claim 12 from "1" to --2--.

At Col. 6, line 58, "of" should be --or--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*